US005534044A

United States Patent [19]

Prasad et al.

[11] Patent Number: 5,534,044

[45] Date of Patent: Jul. 9, 1996

[54] SELF-LUBRICATING ALUMINUM METAL-MATRIX COMPOSITES

[75] Inventors: Somuri V. Prasad, Dayton; Karl R. Mecklenburg, Fairborn, both of Ohio

[73] Assignee: The United States of America as represented by the Secretary of the Air Force, Washington, D.C.

[21] Appl. No.: 348,687

[22] Filed: Nov. 28, 1994

[51] Int. Cl.[6] ..... C22C 29/00

[52] U.S. Cl. ..... 75/231; 384/912

[58] Field of Search ..... 75/231; 384/912

[56] References Cited

U.S. PATENT DOCUMENTS

| | | | |
|---|---|---|---|
| 5,128,213 | 7/1992 | Tanaka et al. | 75/231 |
| 5,197,528 | 3/1993 | Burke | 164/97 |

OTHER PUBLICATIONS

S. V. Prasad and P. K. Rohatgi, *Tribological Properties of Al Alloy Particle Composites,* Journal of Metals, Nov. 1987, pp. 22–26.

Yuko Tsuaya, Hirobumi Shimura and Masahisa Matsunaga, *A Study on Some Metal–Base Self–Lubricating Composites Containing Tungsten Disulfide,* Lubrication Engineering, Nov. 1973, pp. 498–508.

*Primary Examiner*—Melvyn Andrews

*Attorney, Agent, or Firm*—Charles E. Bricker; Thomas L. Kundert

[57] ABSTRACT

A self-lubricating aluminum alloy bearing material which can be used in vacuum, dry or moist environments which consists essentially of about 0.5 to 25, preferably about 5–20 volume percent of hard ceramic particles and about 1 to 7, preferably 3–5 volume percent of at least one solid lubricant, balance an aluminum alloy.

6 Claims, No Drawings

SELF-LUBRICATING ALUMINUM METAL-MATRIX COMPOSITES

RIGHTS OF THE GOVERNMENT

The invention described herein may be manufactured and used by or for the Government of the United States for all governmental purposes without the payment of any royalty.

BACKGROUND OF THE INVENTION

This invention relates to aluminum metal-matrix composites for use in tribological applications.

The major drawback of aluminum alloys in tribological applications is their poor resistance to seizure and galling. Aluminum has a tendency to smear the counterface during sliding contact. Because of this, aluminum alloys are rarely used in applications involving dry sliding contact.

Attempts have been made to improve the tribological performance of aluminum alloys by dispersing solid lubricant particles, such as graphite, through the alloy matrix. The friction coefficient of commercial aluminum alloys is relatively high, generally about 0.5–0.6. Dispersion of graphite through such a matrix can reduce the friction coefficient to about 0.2. However, graphite loses its lubricity in dry environments. Thus, aluminum-graphite composites have limited uses: (a) in environments with relative humidity in excess of 50%, and (b) in boundary lubrication regimes. What is desired is a self-lubricating aluminum alloy bearing material which can be used in vacuum, dry or moist environments.

Accordingly, it is an object of this invention to provide a self-lubricating aluminum alloy bearing material which can be used in vacuum, dry or moist environments.

Other objects and advantages of the present invention will be apparent to those skilled in the art.

SUMMARY OF THE INVENTION

In accordance with the present invention there is provided a self-lubricating aluminum alloy bearing material which can be used in vacuum, dry or moist environments which consists essentially of about 0.5 to 25, preferably about 5–20 volume percent of hard ceramic particles and about 1 to 7, preferably 3–5 volume percent of at least one solid lubricant, with the balance an aluminum alloy.

The solid lubricant can be described by the general formula $MX_2$, wherein M is molybdenum, tungsten or niobium and X is sulfur, selenium or tellurium. Tungsten disulfide ($WS_2$) is widely available and has a high thermal stability. Other transition metal dichalcogenides which may be used include, for example, molybdenum ditelluride ($MoTe_2$) and tungsten ditelluride ($WTe_2$).

The hard ceramic particles can, for example, be silicon carbide (SIC), alumina ($Al_2O_3$), quartz ($SiO_2$), titanium carbide (TIC), tungsten carbide (WC), or other ceramic material which is compatible with the aluminum alloy. It is preferred that these particles have a particle size in the range of about 5 to 20 μm.

The bearing material of this invention can be prepared by powder metallurgy, involving blending, compacting and sintering, or by a squeeze infiltration route. In the latter, a porous hybrid preform consisting of ceramic fibers in the bulk and a mixture of ceramic and solid lubricant particles at the top is first fabricated. The amounts of fibers, particulates and solid lubricants in the preform are determined from the composition of the final composite. This preform is positioned in a die and liquid aluminum alloy is squeeze infiltrated into it.

The alloy can be any aluminum-based alloy, such as, for example, Al-0.4Si-0.7Mg, Al-1.0Si-4.55Cu-1.0Mn-0.5 Mg, or the like. For fabrication by the powder metallurgy route, it is preferred that the material be pre-alloyed in order that the alloying substituents be uniformly dispersed throughout.

The following example illustrates the invention:

EXAMPLE

A series of self-lubricating metal-matrix composites (MMC) were prepared using the following raw materials: matrix alloys: Two prealloyed aluminum alloy powders were employed, Al-0.4Si-0.7Mg (Alcoa type 6063) and Al-1.0Si-4.55Cu-1.0Mn-0.5 Mg (Alcoa type 2124); ceramic phase: Silicon carbide particles, 600 grit.; lubricant phase: Tungsten disulfide.

Four compositions with varying volume fractions of silicon carbide and tungsten disulfide were formulated. Volume fractions were calculated from weight fractions and corresponding densities of the powders. Four batches of model composites were prepared using each of the alloys. The batch compositions are given in Table I, below:

TABLE I

| | Volume Percent | | |
|---|---|---|---|
| Batch No. | Alloy (6063 or 2124) | SiC | $WS_2$ |
| I | 92 | 5 | 3 |
| II | 87 | 10 | 3 |
| III | 85 | 10 | 5 |
| IV | 75 | 20 | 5 |

Each powder batch was blended using a V-Cone blender, under an argon atmosphere about 15 hours at 10 rpm. Each blended batch was compacted in a ¾-inch diameter steel die at a pressure of 400 MPa. The compacted pellets were sintered in a dry argon atmosphere using a tubular furnace. The sintering cycles were: (a) heat to 450° C.; (b) hold for 30 minutes; (c) increase temperature (to 605° C. for alloy 6063 and to 590° C. for alloy 2124); (d) hold for 20 minutes; and (e) furnace cool.

The sintered disks were sequentially rough polished using 2/0, 3/0 and 4/0 silicon carbide emery paper. The disks were then given intermediate polishing using 9 μm and 3 μm diamond pastes. Final polishing was done using a 1 μm diamond suspension. No water was used during the intermediate and final polishing stages. After the final polishing, the specimens were cleaned using soap and steam followed by ultrasonic cleaning in isopropanol.

Friction and wear tests were performed using a ball-on-disk apparatus in which a steel ball was held against a rotating test specimen. Load on the ball was applied by means of deadweights. Friction force was measured using a sensitive (maximum range: 0.5N) force transducer. Wear scars on the MMC disks and steel balls were examined using a scanning electron microscope equipped with wavelength and energy dispersive x-ray spectroscopes. Scar depths on the MMC specimens were measured using a Dektak-II profilometer. The test configuration was: ball, 3.125 mm diameter 440C steel ball; disk, MMC test specimens; normal load, 0.5N (about 50 grams); speed, 200 rpm; and track diameter, 15 mm.

The results of two tests on Batch No. II, 6063 alloy, MMC specimens are given in Tables II and III, below. The test reported in Table II was carried out under a dry nitrogen atmosphere. The test reported in Table III was carried out under the atmosphere of the test laboratory (relative humidity about 65%).

TABLE II

| | (Under dry nitrogen) | |
|---|---|---|
| Time (Cycles) | Friction Force, grams | Friction Coefficient, μ |
| 0 (Initial) | 6.5 | 0.13 |
| 1,000 | 4.5 | 0.09 |
| 10,000 | 2.5 | 0.05 |
| 100,000 | 1.5 | 0.03 |
| 1,000,000 | 1.5 | 0.03 |

TABLE III

| | (In air) | |
|---|---|---|
| Time (Cycles) | Friction Force, grams | Friction Coefficient, μ |
| 0 (Initial) | 5.5 | 0.11 |
| 1,000 | 5.0 | 0.10 |
| 100,000 | 5.0 | 0.10 |
| 1,000,000 | 4.0 | 0.08 |

The average depth of the wear scar for the tests conducted in dry nitrogen was 2.5 μm and the average depth of the wear scar for the tests conducted in air was 3.5 μm. There was no indication of aluminum smearing on the steel counterface for either test.

For comparison, a control test was performed using a commercial Al-Si alloy. The test surface was prepared in the same manner as for the MMC surface(s). Friction and wear testing was performed in laboratory air (relative humidity 65%) at a normal load of 0.5N for a duration of 1,000 cycles. All other test parameters were the same. The friction coefficient in this test was about 0.5–0.6. Smearing of aluminum on the steel counterface was clearly evident.

Examination of the above data reveals that the metal-matrix composite compositions of the present invention provide greatly improved aluminum alloy bearing materials.

Various modifications may be made in the instant invention without departing from the spirit and scope of the appended claims.

We claim:

1. A self-lubricating aluminum alloy bearing material composition which consists essentially of about 0.5 to 25 volume percent of hard ceramic particles and about 1 to 7 volume percent of at least one solid lubricant of the general formula $MX_2$, wherein M is molybdenum, tungsten or niobium and X is selenium or tellurium, balance an aluminum alloy.

2. The composition of claim 1 which consists essentially of about 5–20 volume percent of said hard ceramic particles and about 3–5 volume percent of said solid lubricant, balance said aluminum alloy.

3. The composition of claim 1 wherein said aluminum alloy is Al-0.4Si-0.7Mg.

4. The composition of claim 1 wherein said aluminum alloy is Al-1.0Si-4.55Cu-1.0Mn-0.5Mg.

5. The composition of claim 1 wherein said hard ceramic particles are selected from the group consisting of silicon carbide (SIC), alumina ($Al_2O_3$), quartz ($SiO_2$), titanium carbide (TIC) and tungsten carbide (WC).

6. The composition of claim 1 wherein said hard ceramic particles are silicon carbide.

* * * * *

UNITED SATES PATENT AND TRADEMARK OFFICE

CERTIFICATE OF CORRECTION

PATENT NO. : 5,534,044

DATED : July 9, 1996

INVENTOR(S) : Somuri V. Prasad et al

It is certified that error appears in the above-identified patent and that said Letters Patent is hereby corrected as shown below:

Column 1, line 54, "SIC" should read ---SiC---.

Column 1, line 55, "TIC" should read ---TiC---.

Column 4, line 32, "SIC" should read ---SiC---.

Column 4, line 33, "TIC" should read ---TiC---.

Signed and Sealed this

Eighth Day of April, 1997

*Attest:*

Bruce Lehman

BRUCE LEHMAN

*Attesting Officer*

*Commissioner of Patents and Trademarks*